US005683769A

United States Patent [19]

Cheng

[11] Patent Number: 5,683,769

[45] Date of Patent: Nov. 4, 1997

[54] DECORATIVE GIFT ARTICLE

[76] Inventor: Kui-Eng Cheng, 99 Glencairn Street, Toronto, Ontario, Canada, M4R 1M7

[21] Appl. No.: 437,833

[22] Filed: May 9, 1995

[51] Int. Cl.[6] ..... B65D 77/10; B65D 33/28; B65D 30/28

[52] U.S. Cl. ..... 428/35.2; 428/35.5; 428/36.1; 428/4; 428/5; 428/14; 383/19; 383/72; 383/119; 383/121; 426/106; 426/108; 206/466

[58] Field of Search ..... 383/71, 72, 121, 383/121.1, 18, 19, 104, 119; 428/34.1, 34.3, 35.2, 35.5, 36.1, 4, 5, 14; 426/108, 106, 660; 206/466, 471, 462

[56] References Cited

U.S. PATENT DOCUMENTS

| | | | |
|---|---|---|---|
| 1,691,904 | 11/1928 | Gamble | 383/104 |
| 1,726,523 | 9/1929 | Blows | 383/18 |
| 2,335,359 | 11/1943 | Rosenberg | 383/72 |
| 2,406,660 | 9/1946 | Brady | 383/104 |
| 4,863,284 | 9/1989 | Cheng | 383/18 |
| 4,930,903 | 6/1990 | Mahoney | 383/104 |
| 5,161,895 | 11/1992 | Myers | 383/113 |

*Primary Examiner*—Rena Dye
*Attorney, Agent, or Firm*—Kirschstein et al.

[57] ABSTRACT

A decorative gift article includes a plurality of gift items and a support of a predetermined countenance that is used for presenting the gift items. A pouch accommodates the gift items and is connected to a bottom side of the support. An elongated element, especially a relatively narrow decorative ribbon, having a central portion secured to the bottom side of the support and two free end portions of substantially equal length integral with the central portion is used for establishing the connection between the pouch and the support in that its end portions are tied in a knot about a substantially central portion of the pouch. The gift items fill the pouch less then completely so that the tying of the free end portions of the elongated element around the central portion of the pouch results in the formation of a constriction at such location. The constriction of the pouch is devoid of any of the gift items so that portions of the pouch situated at mutually opposite sides of the constriction sag in the manner of saddlebags.

6 Claims, 1 Drawing Sheet

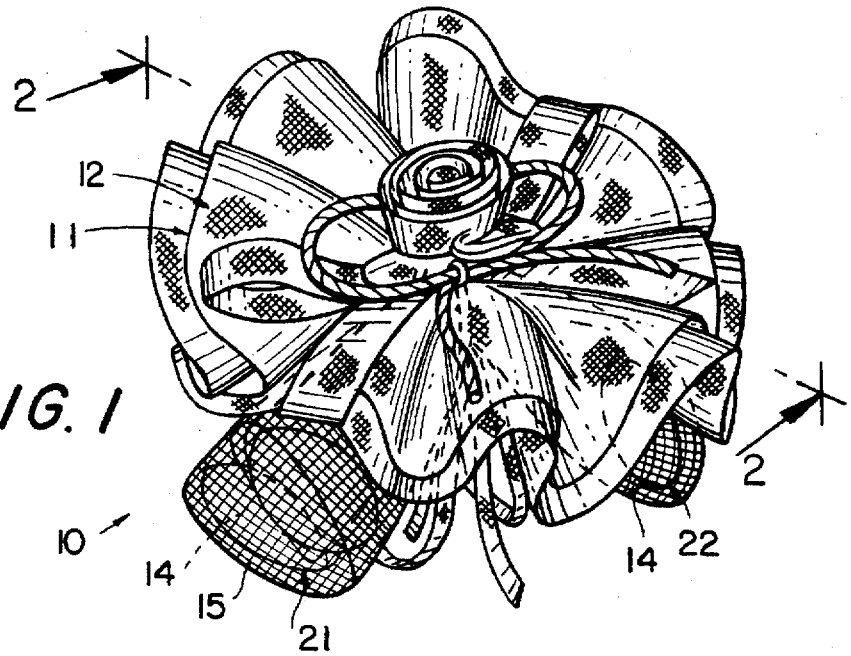
FIG. 1
FIG. 2
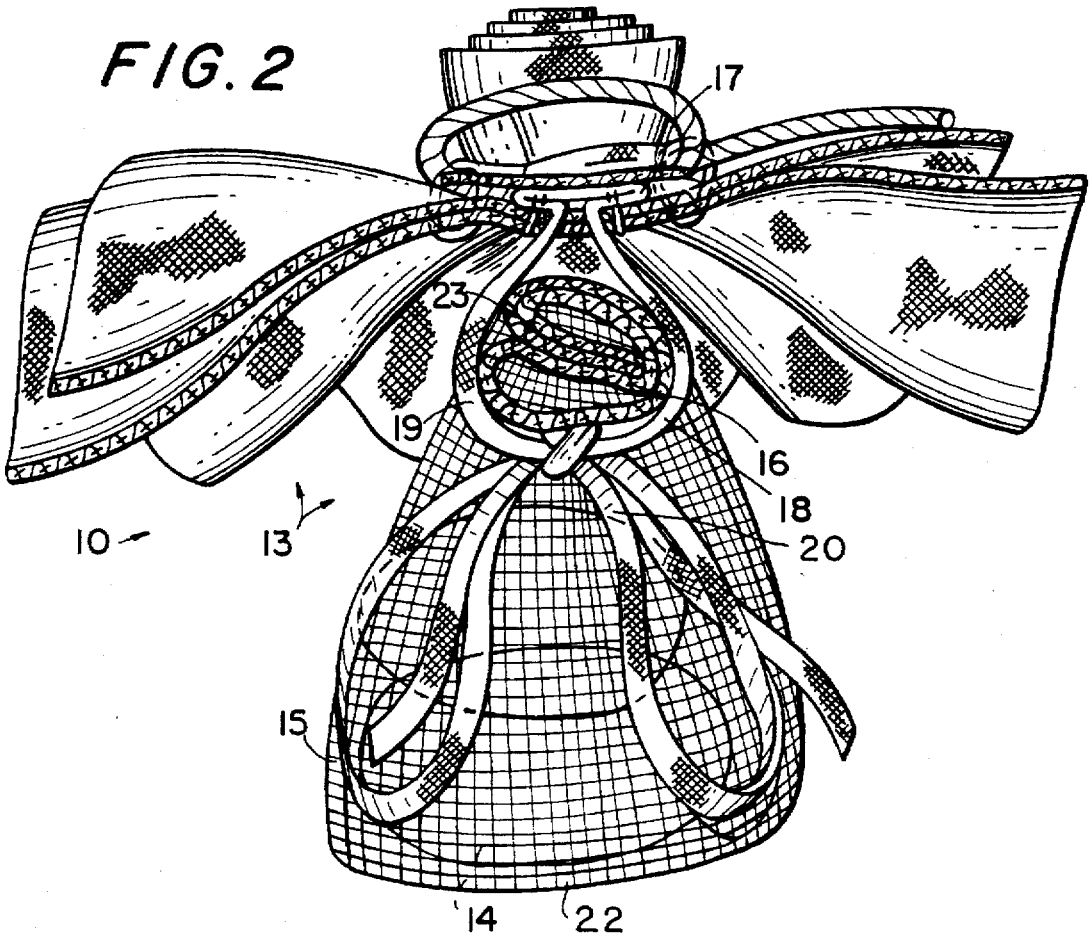

DECORATIVE GIFT ARTICLE

BACKGROUND OF THE INVENTION

1. Field of the Invention

The present invention relates to items to be given as presents in general, and more particularly to arrangements for holding such gift items in a manner that enhances their aesthetic appeal especially as they are being presented.

2. Description of the Related Art

It is a well-established custom in many areas of the world to give certain items as tokens of admiration, esteem, recognition or the like. Such items may range from those which have considerably more than just a token value, such as jewelry, all the way to relatively inexpensive ones, such those of the edible variety, including chocolate or hard candy, other sweets or the like. Other popular items frequently given as presents are natural flowers, ranging from a single rose through a bunch of violets all the way to sometimes quite elaborate flower arrangements.

Moreover, it has also been attempted since time immemorial to take certain measures intended to contribute to or enhance the visual attractiveness of the items being presented. So, for instance, flowers may be wrapped in decorative wrapping paper, chocolate candy may be presented in boxes that may themselves be decorative and/or be wrapped in decorative wrapping paper, etc.

Yet, all such previously known gift ideas have a common disadvantage: as welcome as the present may be when received, it immediately raises a question what to do with it, especially when given on a date. Of course, a box of chocolates can be opened, its contents eaten on the spot, and the box discarded; not too many people do that, though, so that the box is carried around until the recipient finally gets home.

The latter fate befalls flowers as well, inasmuch as to discard them within the eyesight of the gift giver would be at least impolite if not outright rude or insulting. By then, though, they will probably be wilted beyond recovery so that to discard them will be the only option left. While the problem of wilting would not be present if artificial flowers were given instead of real ones, this is usually not an acceptable alternative; moreover, they would still have to be carried around, thus presenting a possibly appreciated, but still at least a slight, nuisance.

OBJECTS OF THE INVENTION

Accordingly, it is a general object of the present invention to avoid the disadvantages of the prior art.

More particularly, it is an object of the present invention to provide a decorative article to be given as a gift, which article does not possess the drawbacks of the known articles of this type.

Still another object of the present invention is to devise a decorative article of the type here under consideration which can be easily placed on a convenient location of the body, garments or accessories of the recipient so as not to interfere with the recipient's activities.

It is yet another object of the present invention to design the above article in such a manner as to make it appealing to the recipient.

A concomitant object of the present invention is so to construct the article of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in a decorative gift article that includes a plurality of gift items, and means for presenting the gift items. According to the invention, such presenting means includes a support of a predetermined countenance having top and bottom sides, and means for retaining the gift items on the support at the bottom side thereof. The countenance can be of any three-dimensional object, preferably a flower. A particular advantage of the construction of the decorative gift article as described so far is that it renders it possible to present the gift items in question, such as candy, in a practical yet tasteful manner.

More particularly, the practical aspect can be found in the compact configuration of the support which renders it possible to easily find a place at a location associated with the recipient for joint movement where to keep the article until a more permanent location can be found, without inconveniencing or interfering with any activities of the recipient. On the other hand, the tastefulness resides in the aesthetically pleasing flower-like appearance of the support and in a commensurately attractive arrangement of the gift item at the bottom side of the flower-like support.

Advantageously, the retaining means includes a pouch for accommodating the gift items, and means for connecting the pouch to the bottom side of the support. It is especially advantageous when, in accordance with an aspect of the present invention, the connecting means includes an elongated element, especially a relatively narrow decorative fabric ribbon, having a central portion secured to the bottom side of the support and two free end portions of substantially equal length integral with the central portion, with the end portions being tied in a knot about a substantially central portion of the pouch to connect the latter to the support. The element could also be a drawstring.

According to an advantageous facet of the present invention, the gift items fill the pouch less then completely so that the tying of the free end portions of the elongated element around the central portion of the pouch results in the formation of a constriction at such location. In this context, it is particularly advantageous when the constriction is devoid of any of the gift items so that portions of the pouch situated at mutually opposite sides of the constriction sag in the manner of saddlebags.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 1 is a perspective view of a decorative article of the present invention; and FIG. 2 is a sectional view at an enlarged scale taken on line 2—2 of FIG. 1.

DETAILED DESCRIPTION OF THE PREFERRED EMBODIMENT

Referring now to the drawing in detail, and first to FIG. 1 thereof, it may be seen that the reference numeral 10 has been used therein to identify a decorative article of the present invention in its entirety. The decorative article 10 includes a support member 11 that has a predetermined shape, look, texture, appearance, aesthetic appeal, and/or feel (which are referred to herein individually or in combination as "countenance") reminiscent of any three-dimensional object, such as a flower, a bird, a swan, a clown, etc., and is made from well-known materials currently used in the fabrication of artificial or so-called silk flowers using methods well known in that art or industry. The precise configuration of the support member 11 of the decorative article 10 is of little consequence in the context of the present invention, so long it is presentable and aesthetically pleasing.

In accordance with the present invention, the support member 11, which has a top side or face 12 and a bottom side or face 13, is intended to be given as a present to a person who is adored, esteemed, revered and/or loved by the original owner, but not alone. Rather, it is to be enhanced or otherwise improved by at least one gift item 14, but preferably a plurality of such gift items 14, such as a piece or pieces of foil-wrapped, otherwise wrapped, or even unwrapped hard, soft or even chocolate candy, that is or are held or retained in position on the flower-like support 11.

The manner in which the gift items 14 are retained on the support 11, and more particularly at its bottom side 13, is indicated in some detail in FIG. 2 of the drawing. As shown there, there is provided a unitary pouch 15 of a relatively highly flexible material. The pouch 15 is indicated to accommodate a plurality or multitude of the gift items 14 situated next to one another. The gift items 14 do not completely fill the pouch 15, however; rather, they utilize the space available within the pouch 15 to less than the maximum extent. This is important in the context of the present invention because it, in conjunction with the flexible character of the pouch material, renders it possible to form a constriction 16 at any region of the thus filled pouch 15, especially substantially in its middle.

This, in turn, makes it possible to attach the pouch 15 to the bottom side 13 of the support 11 in the manner that can most easily be ascertained from FIG. 2 of the drawing. More particularly, an elongated element 17, such as a string, a wire or, as currently preferred, a relatively narrow fabric ribbon, is secured to the support 11 at its bottom side 13 in any known manner, such as being sewn to or into it at its central region, in such a manner that two substantially equally long end portions 18 and 19 of the elongated element 17 depend downwardly from the bottom side 13 of the flower-like support 11. At this juncture, it is to be mentioned that all references contained herein with respect to various directions and relative positions, such as "up" or "down", "upper" or "lower", "top" or "bottom" are intended, and thus should be perceived, as relating to the orientation of the decorative article 10 that is depicted in the drawings, whereas all references to "central", "radial", "axial", or "circumferential" are similarly related to an axis of the support 11 about which the support is symmetrical or quasi-symmetrical, that is, a vertically extending axis passing substantially through the middle of the support 11 in the orientation illustrated in FIG. 2.

The end portions 18 and 19 are used to connect the pouch 15 to the support 11 in that they are tied around a substantially centrally located region of the pouch 15 to form the constriction 16 at that location. As shown in FIG. 2, the end portions 18 and 19 are tied to a so-called bow knot 20, that is a knot that is commonly used for relatively easily releasable yet quite reliable tying of objects such as bow ties or shoelaces. As indicated in FIG. 2, the resulting formation of the centrally located constriction 16 that usually does not have any of the gift items 14 located therein, results in effect in a subdivision or compartmentalization of the pouch 15 into two radially extending and circumferentially spaced or opposite sections indicated in FIG. 1 by the reference numerals 21 and 22, each containing about a half of the total number of the gift items 14. As a result of the fact that the constriction 16 is devoid of the any of the items 14, it constitutes a hinge of sorts connecting the two sections 21 and 22 but permitting them to sag to a certain extent. Thus, the sections 21 and 22 pend down from the central constriction 16 in a manner not much different from that encountered in saddlebags. Rather than tying the end portions into a knot, a pull-type drawstring can be used to cinch the pouch.

As also indicated in the drawings, the pouch 15 is advantageously of a mesh-like material or netting, be it of textile fibers or of synthetic plastic material. The pouch 15 has a non-illustrated opening through which the gift items 14 can be first introduced into the pouch 15 and subsequently removed therefrom after untying the knot 20. That opening is situated at a region of the pouch 15 that passes through the constriction 16. As indicated by the reference numeral 23, that region is folded over on itself at least within the confines of the constriction 16. This effectively and reliably closes the opening of the pouch 15 so that the items 14 are not able to accidentally fall out of the pouch 15.

It will be understood that each of the elements described above, or two or more together, may also find a useful application in other types of constructions differing from the type described above.

While the present invention has been described and illustrated herein as embodied in a specific construction of a decorative gift article, it is not limited to the details of this particular construction, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A decorative gift article, comprising:

a) a decorative support having a top and a bottom;

b) a flexible pouch connected to the bottom of the support;

c) an elongated element having a central portion secured to the support, and a pair of end portions tied around a central region of the pouch to form a constriction at the central region, said constriction subdividing the pouch into a pair of hollow pouch sections that are suspended to hang downwardly away from the bottom of the support; and d) a plurality of gift items, at least one of the gift items being accommodated within each of the pouch sections.

2. The decorative gift article as defined in claim 1, wherein said pouch is a netting.

3. The decorative gift article as defined in claim 4, wherein said end portions are tied in a bow knot.

4. The decorative gift article as defined in claim 3, wherein said end portions are of equal length.

5. The decorative gift article as defined in claim 1, wherein said element is a relatively narrow decorative fabric ribbon.

6. The decorative gift article as defined in claim 1, wherein said gift items are edible confections.

* * * * *